US006923343B1

(12) United States Patent
Erxleben

(10) Patent No.: US 6,923,343 B1
(45) **Date of Patent: *Aug. 2, 2005**

(54) CHILD RESISTANT SLIP COLLAR FOR SCREW-ON PUMP SPRAYER

(76) Inventor: Frederick R. Erxleben, 2 Arbor Dr., Brick Township, Ocean County, NJ (US) 08724

( * ) Notice: Subject to any disclaimer, the term of this patent is extended or adjusted under 35 U.S.C. 154(b) by 0 days.

This patent is subject to a terminal disclaimer.

(21) Appl. No.: 09/533,834

(22) Filed: Mar. 23, 2000

(51) Int. Cl.[7] ..... B67B 5/00

(52) U.S. Cl. ..... 222/153.09; 222/321.7; 215/219

(58) Field of Search ..... 222/153.09, 153.1, 222/499, 372, 321.7; 215/216, 219

(56) References Cited

U.S. PATENT DOCUMENTS 3,822,805 A * 7/1974 Marchant ..... 215/9

3,892,325 A * 7/1975 Maguire ..... 215/219

* cited by examiner

*Primary Examiner*—Kevin Shaver
*Assistant Examiner*—Melvin A. Cartagena

(57) ABSTRACT

The present invention relates to a screw-on, manually operated sprayer and container. The sprayer has an inside threaded sprayer neck and the container has an outside threaded container neck upon which the inside threaded sprayer neck is attached. The present invention relates to the improvement of providing a child-resistant safety feature. This feature is a non-flexible collar attached to the outside of the sprayer neck and adapted to freely rotate about the sprayer neck to inhibit undesired unthreading or threading of the sprayer neck from or to the container neck. The collar has a continuous sidewall, an open top with a top rim, an open bottom with a bottom rim, positioning means located on the collar to maintain a predetermined position of the collar relative to the sprayer neck, antiremoval means located on the collar to prevent removal of the collar from the sprayer neck, and at least one flexible engagement means located on the sidewall.

13 Claims, 4 Drawing Sheets

CHILD RESISTANT SLIP COLLAR FOR SCREW-ON PUMP SPRAYER

BACKGROUND OF THE INVENTION

1. Field of the Invention

This invention relates to fluid dispensers, and, more particularly, to child-resistant collars for screw-on pump sprayers. The collars require a complex motion of depressing a part of the collar while turning it.

2. Information Disclosure Statement

The following patents are representative of child resistant collars for screw-on pump sprayers:

U.S. Pat. No. 3,927,834 to Tetsuya Tada describes a sprayer which comprises a piston capable of being reciprocatingly moved in a cylindrical chamber, a lever for operating said piston, a valve for guiding a spray liquid from a container to said chamber, and a locking member for fixing said lever in a prescribed position and simultaneously allowing said piston to close said valve when the sprayer is out of use.

U.S. Pat. No. 4,204,614 to Randy F. Reeve describes a fluid dispenser which includes an actuator containing fluid passages defining a discharge path for fluid from a supply container to a discharge orifice, a needle valve lying adjacent the discharge path, a nipple surrounding the needle valve and a nozzle cap having an end wall containing a discharge orifice and being threadedly engaged with the nipple for movement of the end wall toward and away from the valve upon cap rotation. Discharge through the orifice may be positively shut-off upon rotation of the cap which causes the valve to be seated against the discharge orifice, and the nozzle cap may be locked in an off position upon engagement between a spring biased tab provided on the actuator and an inwardly extending shoulder provided on the skirt of the cap. A ramp member on the cap includes a ramp surface and the shoulder so as to effect inward deflection of the tab upon engagement with the ramp surface during cap rotation toward the off position. The tab then snaps into place against the shoulder upon continued cap rotation so as to prevent rotation of the cap which would cause the valve to unseat from the discharge orifice. The tab is manually deflectable for disengaging it from the shoulder to permit cap rotation allowing its end wall to move away from the valve.

U.S. Pat. No. 4,346,821 to Walter H. Wesner et al. describes a child resistant safety closure which is provided for closing the outlet of a hand-operated fluid product sprayer dispenser which is used on a container to prevent leaks from the container during periods of non-use and to resist accidental use by children or unwary adults. The closure cannot be moved from an "outlet closed" position to an "outlet open" position without the performance of at least two discrete, predetermined definite actions by the user to first disable a lock and then to linearly or rotatably move the cap into the "outlet open" position to permit spraying or dispensing. A closing member is connected to the bottom portion of the sprayer for removably mounting the sprayer to the container and closing the same. The member and the sprayer to which it is connected cannot be removed without the performance of at least two discrete, predetermined definite actions, which actions are difficult if not impossible for young children to perform.

U.S. Pat. No. 4,336,921 to Donald C. Kirk, Jr. describes a child resistant closure for a container having a threaded cylindrical neck. The container neck is provided with a plurality of outwardly extending ratchet-teeth on its exterior surface below the thread. The cap portion of the closure has a central opening in its top surface that receives the base of the article to be attached to the container neck, e.g. a trigger pump. A collar member is received on the lower end of the closure member and is axially movable thereon. The collar member is provided with a plurality of ratchet-teeth adapted to engage the ratchet-teeth on the neck of the container when the collar is in its lower or down position. The cap has spaced apart splines on its skirt which define recesses that receive inwardly directed lugs provided at the top of the collar. The engagement of the lugs and splines permit the collar to move axially on the cap but prevents separate radial movement between the collar and cap.

U.S. Pat. No. 4,454,965 to Donald C. Kirk, Jr. describes a child resistant trigger pump dispenser having an elongated, transversely oriented body member with the pump outlet at one end thereof and a vertically extending lower end section for receiving fluid from a container. The lower end section of the pump is equipped with a rigidly attached closure member having a multiplicity of short threads with projections adjacent their ends on the inner wall of the downwardly depending skirt. The container neck is provided on its outside surface with a multiplicity of long interrupted threads, some having recessed portions on their underside adjacent their terminal ends to receive the projections on the short threads on the closure member skirt portion. The closure member is provided with an upstanding boss which is received in an opening provided in the lower portion of the body member for accommodating the trigger arm whereby the transverse axis of the trigger pump can be oriented with respect to the engaging lugs provided on the closure means when the closure member is permanently fixed to the pump. The closure member is fixedly attached to the lower portion of the pump body during assembly so that when the pump is connected to an oval or non-cylindrical container having the long interrupted threads the projections on the short threads of the closure will engage the undercuts on the long threads so that the transverse axis of the pump is in alignment with the major transverse axis of the container to provide fixed orientation of the pump with respect to the container.

U.S. Pat. No. 4,781,311 to Walter B. Dunning et al. describes a cap and container especially suited for dispensing liquids which has a cap which is accurately aligned upon closure. The container is closed by applying downward axial pressure to the cap, thereby forcing lugs in the cap to pass over threads located on the neck of the container so that the cap is snapped on. Stop walls prevent any undesired cap rotation. Stabilizing lugs are alternatively provided to add additional stability. Alternatively, the container is closed by twisting or rotating the cap with respect to the neck. The cap may also be twisted or snapped off. Modifications in the neck configuration make the cap irremovable.

U.S. Pat. No. 5,169,032 to Emile B. Steijns et al. describes a trigger operated fluid dispensing device which is adapted to be mounted to a container. The device comprises a body having a top wall portion and front end portion. A nozzle assembly is provided at the front of the body and comprises a nose bushing at the front end of the body and a nozzle cap rotatably mounted to the nose bushing. The nozzle cap has blocking structure that is engageable with structure that prevents rotation of the nozzle cap. A pull-away piece is detachably connected to the top wall portion of the body and has extending structure extending into the area between the nozzle cop and the front end of the body for engaging the blocking structure for preventing relative movement between the nozzle cap and the body.

U.S. Pat. No. 5,238,152 to Wilhelmus J. J. Maas et al. describes a child resistant trigger sprayer bottle cap/bottle neck assembly which comprises a trigger sprayer having a body which includes a cylindrical base. First coupling structure in the form of at least one deflectable tab with an opening therein is incorporated into the cylindrical base for coupling to a bottle neck. Second coupling structure in the form of a locking lug is provided on a bottle neck and is adapted to engage and couple with the first coupling structure by reason of the lug being received in the opening in the tab. There is also provided a locking ring which is received over the cylindrical base mounted on the neck for maintaining the first and second coupling structures in a coupled locked position.

U.S. Pat. No. 5,356,043 to Kenneth P. Glynn discloses a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an inwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it cannot be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,462,181 to Kenneth P. Glynn discloses a dispenser closure which includes a main closure base attached to a container, an outer ring, an inner cap removably attached to the base and an overcap. The main closure base has a top portion with a circular horizontal track thereon for attachment with an outer ring. The outer ring has a circular inside wall with a horizontal track thereon for attachment to the track of the base so as to connect them to the base in such a way as to be horizontally and freely rotatable thereabout. The outer ring has a top with an inwardly biased ledge for retaining an overcap to be inserted and removed from the outer ring. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it cannot be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

U.S. Pat. No. 5,477,989 to Wilhelmus J. J. Maas et al. describes a child resistant nozzle which is used to cover a nozzle cap of a nozzle assembly for a trigger sprayer having a body, the nozzle assembly including a nose bushing at a front end of the body, the nozzle cap being rotatably mounted on the nose bushing of the sprayer, and the nozzle cap having a proximal end, a distal end including a generally annular rear edge, and an outer surface. The cover comprises a generally annular hood substantially covering the outer surface of the nozzle cap, being rotatable about the nozzle cap and nose bushing and having a proximal end, a distal end, an outer peripheral surface and an inner generally annular surface. Retaining structure is provided at the proximal end of the hood for retaining the hood on the nozzle assembly. The hood is made of flexible or resilient material so that upon applying sufficient radial forces to the hood generally on a diameter extending transversely of the hood, the hood becomes distorted and frictionally engages the nozzle cap whereby the nozzle cap can be rotated by rotating the hood then engaging the nozzle cap.

U.S. Pat. No. 5,509,580 to Kenneth P. Glynn discloses a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizontal track thereon for attachment to the track of the base so as to connect them in such a way as to be horizontally and freely rotatable thereabout. The outer ring has a top with an outwardly biased ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out.

U.S. Pat. No. 5,551,582 to Clayton L. Robinson describes a child resistant, snap on, twist off closure container package which is opened by squeezing and deflecting diametrically opposed side portions of the closure to bring cam followers into engagement which cams on the container so that subsequent turning causes axial displacement and opening movement of the closure from the container. Guide members-prevent deforming of the closure to maintain sealing surfaces and adjoining surfaces of the closure and container in alignment with each other and prevent distortion on to expose surfaces which can be gripped by the fingers or teeth in an effort to open the closure and container in a manner other than the intended method of squeezing and twisting of the closure relative to the container.

U.S. Pat. No. 5,873,496 to Pedro Pares Montaner et al. describes a dispenser which has its closure cap non-removably affixed to a cylindrical attaching portion of its dispenser body by a snap-fit engagement between a folded lower end section of the attaching portion and the closure or a plug located within the closure and in engagement with the attaching portion. The folded lower end section presents an end edge facing outwardly of the closure which engages an inwardly facing end wall of the closure or of the plug.

U.S. Pat. No. 5,938,081 to Donald D. Foster et al. describes a closure which comprises a cap and container where the cap is integrally formed with a trigger sprayer housing and the cap and container have four thread connectors that attach the cap to the container by a quarter turn of the cap relative to the container, and where the cap also has locking tabs that snap over detents on the container and hold the cap securely to the container preventing unintended separation of the cap from the container.

U.S. Pat. No. 5,938,082 to Donald D. Foster et al. describes a container assembly which comprises a container for containing fluid, and a container closure. The container includes a neck having a mouth therein for passage therethrough of liquid in the container, and a flange circumscribing and extending radially outwardly from the neck of the container. The flange includes a generally downwardly facing surface. The container closure comprises a closure cap portion adapted for releasable connection to the neck of the container. The closure cap portion comprises a generally annular-shaped skirt, and at least three protrusions extending generally radially inwardly from an inside surface of the skirt. The protrusions are circumferentially spaced from each other along the inside surface of the skirt. The protrusions of the closure cap portion and the flange of the container are configured for a resilient snap-fit engagement of the protrusions with the generally downwardly facing surface of the flange.

Notwithstanding the prior art, the present invention is neither taught nor rendered obvious thereby.

SUMMARY OF THE INVENTION

The present invention relates to a screw-on, manually operated sprayer and container. The sprayer has an inside threaded sprayer neck and the container has an outside threaded container neck upon which the inside threaded sprayer neck is attached. The present invention relates to the improvement of providing a child-resistant safety feature. This feature is a non-flexible collar attached to the outside of the sprayer neck and adapted to freely rotate about the sprayer neck to inhibit undesired unthreading or threading of the sprayer neck from or to the container neck. The collar has a continuous sidewall, an open top with a top rim, an open bottom with a bottom rim, positioning means located on the collar to maintain a predetermined position of the collar relative to the sprayer neck, antiremoval means located on the collar to prevent removal of the collar from the sprayer neck, and at least one flexible engagement means located on the sidewall. The flexible engagement means is moveable inwardly to frictionally engage the sprayer neck for frictional engagement therewith to permit removal of the sprayer neck and collar simultaneously from the container neck, and to permit attachment of the sprayer neck and collar simultaneously to the container neck. This is accomplished by depressing the at least one flexible engagement means against the sprayer neck and rotating the collar while so depressing the flexible engagement means.

In one embodiment, the positioning means of the collar is an inwardly projecting protrusion located on the top rim of the collar and adapted to rest atop the sprayer neck. In another embodiment, the antiremoval means of the collar is an inwardly projecting protrusion located on the bottom rim of the collar and adapted to fit under the sprayer neck. In some preferred embodiments, the flexible engagement means is at least one hinged engagement means which is a partially cut out portion of the sidewall. In more preferred embodiments, the flexible engagement means is two hinged engagement means, e.g. the two hinged engagement means are located opposite one another. These may be integrally formed with the collar as a single piece.

The present invention may embody a screw-on, manually operated sprayer and container wherein the manually operated sprayer is a vertical pump sprayer. Alternatively, the screw-on, manually operated sprayer and container may have a trigger sprayer. In some embodiments, the hinged engagement means may include a friction enhancing outer surface. In other embodiments, the hinged engagement means includes a friction enhancing inner surface.

Some embodiments of the present invention include a screw-on, manually operated sprayer and container wherein the antiremoval means is adapted to snap onto the sprayer neck and is sufficiently flexible to fit over the sprayer neck and lock onto the sprayer neck to inhibit All removal and permit rotation.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
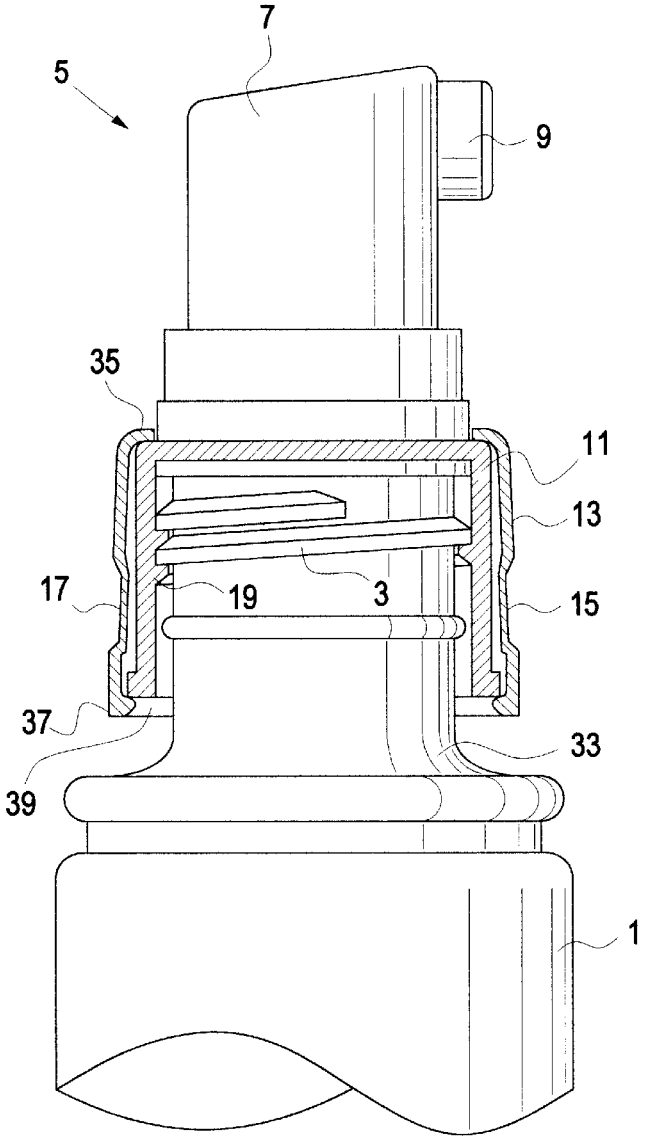
FIG. 1 shows a side, partial cut, partial view.

The present invention relates to a screw-on, manually operated sprayer and container. The sprayer has an inside threaded sprayer neck and the container has an outside threaded container neck upon which the inside threaded sprayer neck is attached. The present invention relates to the improvement of providing a child-resistant safety feature. This feature is a non-flexible collar attached to the outside of the sprayer neck and adapted to freely rotate about the sprayer neck to inhibit undesired unthreading or threading of the sprayer neck from or to the container neck. The collar has a continuous sidewall, an open top with a top rim, an open bottom with a bottom rim, positioning means located on the collar to maintain a predetermined position of the collar relative to the sprayer neck, antiremoval means located on the collar to prevent removal of the collar from the sprayer neck, and at least one flexible engagement means located on the sidewall.

Referring to FIGS. 1 through 4, there is shown a present invention vertical pump sprayer 5 having a container 1 with external container threads 3 on the container neck 33, and a pump pusher mechanism 7 with a dispensing orifice 9. Attached to the container neck 33 is a sprayer neck 11 having internal sprayer threads 19. Internal sprayer threads 19 and external container threads 3 mate with each other.

Attached to the outside of sprayer neck 11 is a non-flexible collar 13 which is adapted to freely rotate about the sprayer neck 11 to inhibit undesired unthreading or threading of the container neck 33 from or to the sprayer neck 11. The collar 13 has a continuous sidewall 35, an open top with a top rim 21 and an open bottom with a bottom rim 37.

Figure 3:
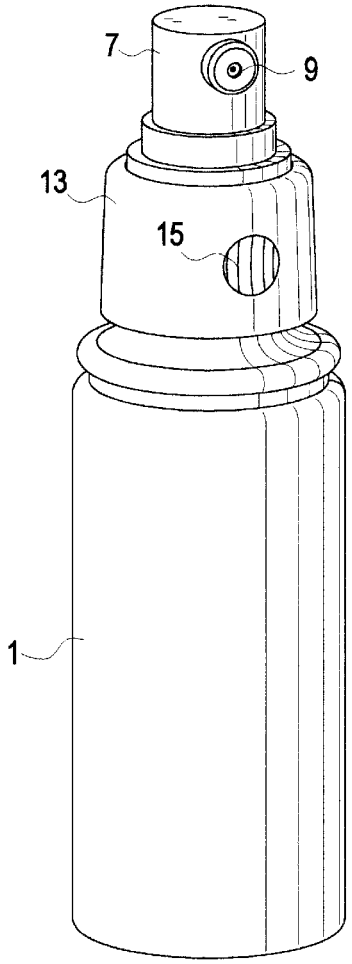
FIGS. 3 and 4 show front oblique views thereof in use.
Figure 4:
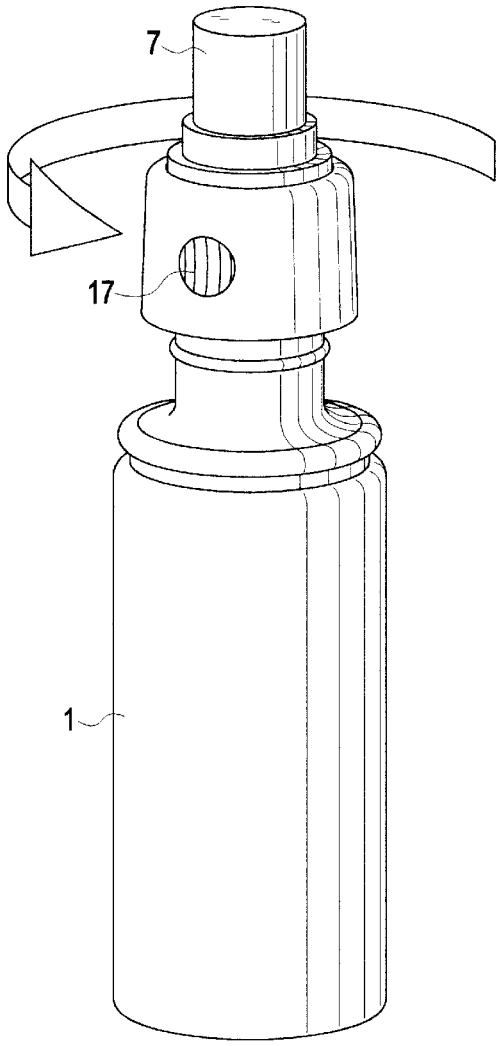

Sidewall 35 includes at least one flexible engagement means 15, 17, which is moveable inwardly to frictionally engage the sprayer neck 11. As shown in FIGS. 3 and 4, at least one flexible engagement means 15, 17 includes serrations so that fingers do not slip when the engagement means 15, 17 is depressed. The at least one flexible engagement means 15, 17 are thins portions of the sidewall 34, which are integrally formed with the collar 13 as a single piece. As shown, the at least one flexible engagement means 15, 17 have an approximately same width across an entire length of the at least one flexible engagement means 15, 17.

Figure 2:
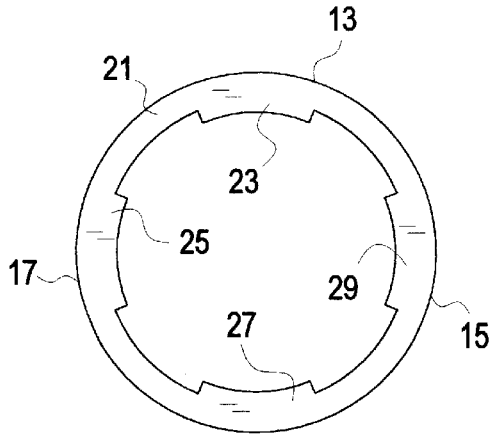
FIG. 2 shows a top view of the present invention collar shown in FIG. 1.

The open top includes positioning means 23, 25, 27, and 29, which maintain a predetermined position of the collar 13 to the sprayer neck 11. As shown in FIG. 2, positioning means 23, 25, 27 and 29 are inwardly projecting protrusions on the top rim 21 of the collar 13 and are adapted to rest atop the sprayer neck 11.

The collar 13 includes an antiremoval means 39 for preventing removal of the collar 13 from the sprayer neck 11. As shown in FIG. 1, antiremoval means 39 is an inwardly projecting protrusion located on the bottom rim 37 and is adapted to fit under the sprayer neck 11. Anti removal means 39 is adapted to snap onto the sprayer neck 11 and is sufficiently flexible to fit over the sprayer neck 11 to inhibit removal and permit rotation.

In operation, as shown in FIG. 4, the at least one flexible engagement means 15, 17 permit removal of the sprayer neck and collar 13 simultaneously from the container neck 33 and permit attachment of the sprayer neck 11 and collar 13 simultaneously to the container neck 33 by depressing the at least one engagement means 15, 17 and rotating the collar at the same time as depressing the at least one flexible engagement means 15, 17.

Figure 5:
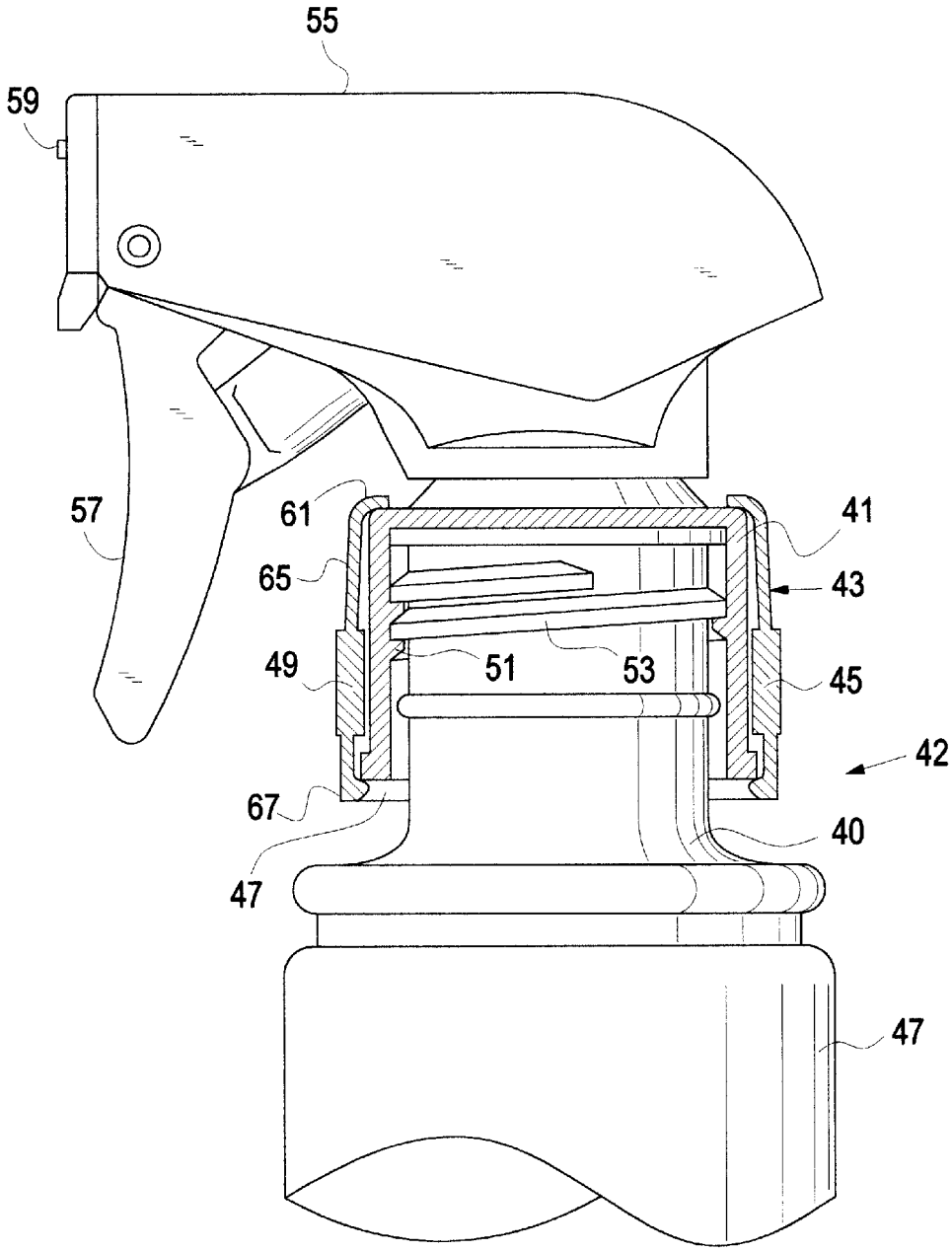
FIG. 5 shows a side partially cut view of an alternative embodiment present invention trigger sprayer and container.

Referring now to FIG. 5, there is shown a side partially cut view of an alternative embodiment present invention trigger sprayer and container 42. In this embodiment, there is shown a trigger sprayer mechanism 55. The trigger sprayer mechanism 55 has a trigger 57 which is pulled back to cause fluid to flow from a container 47 through a hose and out through dispensing orifice 59. The container 47 includes external container threads 53 on the container neck 40. Attached to the container neck 40 is a sprayer neck 41 having internal sprayer threads 51. Internal sprayer threads 51 and external container threads 53 mate with each other.

Attached to the outside of sprayer neck 41 is a non-flexible collar 43 which is adapted to freely rotate about the sprayer neck 41 to inhibit undesired unthreading or threading of the container neck 40 from or to the sprayer neck 41. The collar 43 has a continuous sidewall 65, an open top with a top rim 61 and an open bottom with a bottom rim 67.

Sidewall 65 includes at least one flexible engagement means 45, 49, which is hingedly moveable inwardly to frictionally engage the sprayer neck 41. The collar 43 also includes an antiremoval means 47 for preventing removal of the collar 43 from the sprayer neck 41. Antiremoval means 47 is an inwardly projecting protrusion located on the bottom rim 67 and is adapted to fit under the sprayer neck 41. In operation, the attachment and removal of the collar 43 from the sprayer neck 41 is the same as in the embodiment shown in FIGS. 1 through 4. Only by depressing the at least one engagement means 45, 49 against the sprayer neck 41 and rotating the collar 43 simultaneously can the sprayer neck 41 and collar 43 be removed.

Figure 8:
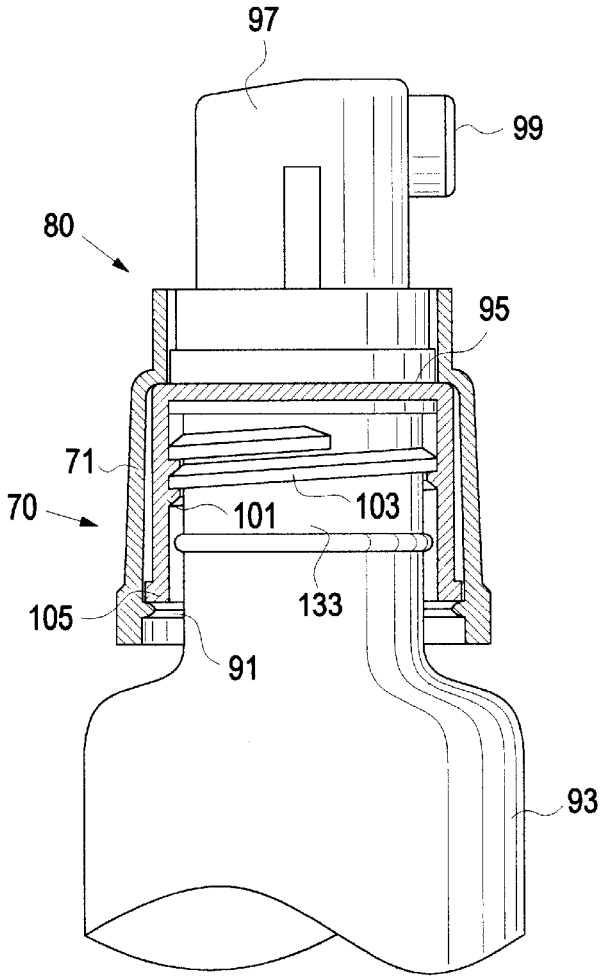
Figure 6:
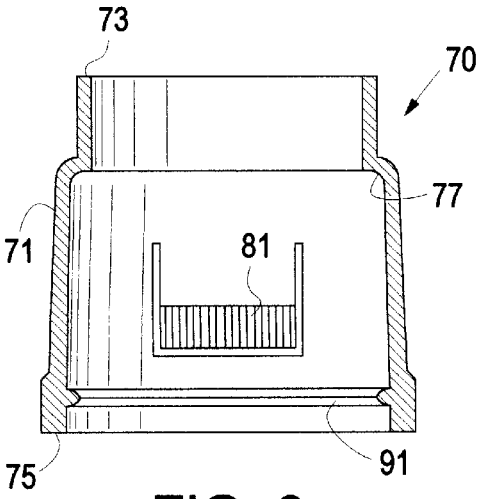
FIGS. 6 and 7 show front and cut side views of an alternative embodiment collar used in a present invention device; and, FIG. 8 shows a partially cut partial side view of a present invention sprayer and container utilizing the collar shown in FIGS. 6 and 7.
Figure 7:
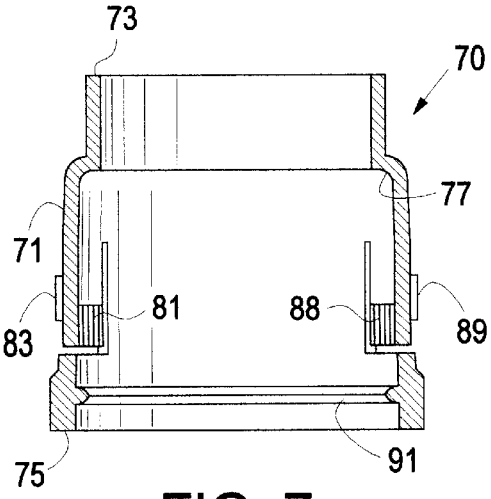

Referring now to FIGS. 6, 7 and 8, there is shown an alternative embodiment of a collar 70 used in a present invention device 80. The device 80 includes a container 93 with external container threads 103 on the container neck 133, and a pump pusher mechanism 97 with a dispensing orifice 99. Attached to the container neck 133 is a sprayer neck 95 having internal sprayer threads 101. Internal sprayer threads 101 and external container threads 103 mate with each other.

The collar 70 is circular and is adapted to freely rotate about the sprayer neck 95 to inhibit undesired unthreading or threading of the container neck 133 from or to the sprayer neck 95. The collar 70 has a continuous sidewall 71 with a positioning means, in this case curved portion 77, an open top 73, an open bottom 75, and an anti-removal means 91 for preventing removal of the collar 70 from the sprayer neck 95. The positioning means engages the sprayer neck 95, thereby maintaining a predetermined position of the collar 70 and the sprayer neck 95. Anti-removal means 91 is an inward projection protrusion above the bottom 75 of the collar 70 and is adapted to fit under the sprayer neck 95.

Extending outwardly from sidewall 71 is at least one flexible engagement means 81, 83, 88 which is moveable inwardly to frictionally engage the sprayer neck 95. As shown in FIGS. 6 and 7, at least one flexible engagement means 81, 83 88 is hinged and serrated to frictionally enhance the grasp with a hand. In addition, the inner surface of the at least one flexible engagement means 81, 83, 88 is serrated to frictionally enhance the engagement with the sprayer neck 95.

Obviously, numerous modifications and variations of the present invention are possible in light of the above teachings. It is therefore understood that within the scope of the appended claims, the invention may be practiced otherwise than as specifically described herein.

What is claimed is:

1. In a screw-on, manually operated sprayer and container, the sprayer having an inside threaded sprayer neck and the container having an outside threaded container neck upon which the inside threaded sprayer neck is attached, the improvement of providing a child-resistant safety feature, which comprises:

a non-flexible collar attached to the outside of said sprayer neck and adapted to freely rotate about said sprayer neck to inhibit undesired unthreading or threading of said sprayer neck from or to said container neck, said collar having a continuous sidewall, an open top with a top rim, an open bottom with a bottom rim, positioning means located on said collar to maintain a predetermined position of said collar relative to said sprayer neck, antiremoval means located on said collar to prevent removal of said collar from said sprayer neck, and at least one flexible engagement means being thins portion of said sidewall integrally formed with said collar as one piece having an approximately same width across an entire length of said at least one flexible engagement means and being moveable inwardly to frictionally engage said sprayer neck for frictional engagement therewith to permit removal of said sprayer neck and collar simultaneously from said container neck, and to permit attachment of said sprayer neck and collar simultaneously to said container neck, by depressing said at least one flexible engagement means against said sprayer neck and rotating said collar while so depressing said at least one flexible engagement means.

2. The screw-on, manually operated sprayer and, container of claim 1 wherein said positioning means of said collar is an inwardly projecting protrusion located on said top rim of said collar and adapted to rest atop said sprayer neck.

3. The screw-on, manually operated sprayer and container of claim 1 wherein said antiremoval means of said collar is an inwardly projecting protrusion located on said bottom rim of said collar and adapted to fit under said sprayer neck.

4. The screw-on, manually operated sprayer and container of claim 1 wherein said at least one flexible engagement means is at least one hinged engagement means which is a partially cut out portion of said sidewall.

5. The screw-on, manually operated sprayer and container of claim 1 wherein said at least one flexible engagement means is two hinged engagement means.

6. The screw-on, manually operated sprayer and container of claim 5 wherein said two hinged engagement means are located opposite one another.

7. The screw-on, manually operated sprayer and container of claim 5 wherein said two hinged engagement means are two partially cut out portions of said sidewall.

8. The screw-on, manually operated sprayer and container of claim 1 wherein said manually operated sprayer is a vertical pump sprayer.

9. The screw-on, manually operated sprayer and container of claim 1 wherein said manually operated sprayer is a trigger sprayer.

10. The screw-on, manually operated sprayer and container of claim 1 wherein said at least one engagement means is integrally formed with said collar as a single piece.

11. The screw-on, manually operated sprayer and container of claim 1 wherein said at least one engagement means includes a friction enhancing outer surface.

12. The screw-on, manually operated sprayer and container of claim 1 wherein said at least one engagement means includes a friction enhancing inner surface.

13. The screw-on, manually operated sprayer and container of claim 1 wherein said antiremoval means is adapted to snap onto said sprayer neck and is suffficiently flexible to fit over said sprayer neck and lock onto said sprayer neck to inhibit removal and permit rotation.

* * * * *